United States Patent [19]

Momoki et al.

[11] Patent Number: 4,660,017

[45] Date of Patent: Apr. 21, 1987

[54] CHIP-TYPE VARISTOR

[75] Inventors: Takamichi Momoki, Nagai; Shunichi Harada, Yamagata, both of Japan

[73] Assignee: Marcon Electronics Co., Ltd., Nagai, Japan

[21] Appl. No.: 828,713

[22] Filed: Feb. 12, 1986

[30] Foreign Application Priority Data

Mar. 4, 1985 [JP] Japan ..... 60-31439[U ]

[51] Int. Cl.[4] ..... H01C 7/10

[52] U.S. Cl. ..... 338/21; 361/127

[58] Field of Search ..... 338/21, 20; 361/127

[56] References Cited

U.S. PATENT DOCUMENTS 3,916,366 10/1975 Jefferson ..... 338/21

3,959,763 5/1976 Sibley et al. ..... 338/21

4,046,847 9/1977 Kresge ..... 338/21 X 4,212,045 7/1980 Martzloff ..... 361/127

*Primary Examiner*—George H. Miller, Jr.

*Assistant Examiner*—M. M. Lateef

*Attorney, Agent, or Firm*—Oblon, Fisher, Spivak, McClelland & Maier

[57] ABSTRACT

At least two platelike electrodes are arranged on the two major surfaces of a platelike varistor element having rounded sides and corners. A pair of external electrodes are formed on the two major surfaces and are connected to the platelike electrodes. The platelike electrodes partially overlap each other. The portion of the varistor element, sandwiched between the overlapping portions of the electrodes, provides varistor characteristics.

7 Claims, 14 Drawing Figures

CHIP-TYPE VARISTOR

BACKGROUND OF THE INVENTION

The present invention relates to a chip-type varistor (nonlinear resistor) and, more particularly, to a chip-type varistor in which the shape of the varistor has been improved.

Recently, demand has increased for small varistors such as chip-type varistors which can be mounted on printed circuit boards without using lead wires or external terminals.

FIGS. 1–3 show a conventional chip-type varistor. FIG. 1 is a plan view of the varistor, FIG. 2 is a sectional view of the varistor, taken along line A—A′ in FIG. 1, and FIG. 3 is also a sectional view, taken along line B—B′ in FIG. 1. As shown in these figures, the chip-type varistor comprises a thin, rectangular varistor element 11, and two electrodes 12*a* and 12*a*′ formed on one of the two major surfaces of element 11, two electrodes 12*b* and 12*b*′ formed on the other major surface of element 11. The varistor further comprises two electrodes 13 and 13′ covering the ends of element 11. Electrode 13 also covers parts of electrodes 12*a* and 12*b*, thus electrically connecting these electrodes. Similarly, electrode 13′ also covers parts of electrodes 12*a*′ and 12*b*′, electrically connecting electrodes 12*a*′ and 12*b*′. Portion W of element 11, which is sandwiched by the overlapping portions of electrodes 12*a* and 12*b*′ provides varistor characteristic.

As shown in FIGS. 2 and 3, edges 14 and 14′ of element 11 form 90° corners. Electrodes 13 and 13′ are formed on these edges. Electrodes 13 and 13′ are formed by dipping the ends of varistor element 11 in a paste of an electrode material such as Ag or Ag-Pd and then drying and baking the material attained to the ends of element 11. As element 11 is pulled up from the paste, the molten material runs off the corners. As a result, those portions of electrodes 13 and 13′ overlying the 90° corners are invariably too thin.

When a surge current flows through electrodes 13 and 13′, its generated Joule heat will cause melting of the thinest portions of the electrodes because of the high electric resistance of the thinnest portions.

Another problem is that cracks 15 are made in the thinest portions disposed over the corners of element 11 since stress concentrates on the thin portions of electrodes 13 and 13′ in the directions shown in FIGS. 4 and 5 when the volume of organic solvent within the electrode material evaporates during the drying and baking process. In this case, more Joule heat will be generated at those thin portions of electrode 13 and 13′ as a surge current flows through the electrodes, and the thin portions thereof will be more easily melted away.

To prevent said portions of electrodes 13 and 13′ from being melted away or from having cracks 15, element 11 can be dipped in a paste of electrode material, dried and baked several times. This, however, reduces the efficiency with which varistors can be manufactured. In addition, electrodes 13 and 13′ thus formed on the ends of element 11, become too thick. Furthermore, since it is difficult to control the surface evenness of electrodes 13 and 13′, varistors of a uniform shape cannot be obtained. Consequently, the varistor produced through repeated dipping of element 11 in a paste of electrode material cannot be stably mounted on a printed circuit board. This is a crucial drawback for any chip element.

SUMMARY OF THE INVENTION

It is an object of the present invention to provide a chip-type varistor which has precise and therefore uniform dimensions and which can be stably mounted on a printed circuit board.

It is another object of the invention to provide a chip-type varistor having external electrodes with no cracks.

Still another object of this invention is to provide a chip-type varistor characterized of such stability that its lifetime is prolonged as a result of its capacity to withstand surge currents.

According to the present invention, there is provided a chip-type varistor comprising: a platelike varistor element made of a sintered body having rounded sides and corners; a pair of platelike electrodes of a first polarity and different lengths formed on two major surfaces of said varistor element and electrically insulated from each other; a pair of platelike electrodes of a second polarity and different lengths formed on two major surfaces of said varistor element and electrically insulated from each other, one of said electrodes partially overlapping one of the electrodes of the first polarity; a first external electrode formed on one of the two ends of said varistor element and connecting the electrodes of the first polarity; and a second external electrode formed on the other end of said varistor element and connecting the electrodes of the second polarity. In this varistor, that portion of said varistor element which is sandwiched by the overlapping portions of the electrode of the first polarity and electrode of the second polarity provides varistor characteristics.

In the present invention, a platelike varistor element with rounded sides and corners is used. Therefore, the electrodes formed on the ends of this element have no cracks at these corners because these electrodes are then made sufficiently thick at these corners even when they are formed by dipping the ends of the varistor element only once in a paste of electrode material. The varistor of this invention, therefore, has precise and uniform dimensions and can be stably mounted on a printed circuit board and has a long lifetime since the electrodes withstand surge currents.

DETAILED DESCRIPTION OF THE PREFERRED EMBODIMENT

One embodiment of the invention will be described in detail with reference to the accompanying drawings.

FIGS. 6–10 show the first embodiment, i.e., a chip-type varistor. As shown in these figures, the varistor comprises a thin, rectangular varistor element 2 made by pressing a ceramic powder mixture containing zinc oxide as a major component and several other metal oxides as minor components and by drying and sintering the pressed mixture. Element 2 has rounded sides and corners 1 and 1' formed during the pressing of the ceramic powder mixture. Two platelike electrodes 3*a* and 3*a'* are formed on one of the two major surfaces of element 2, and two platelike electrodes 3*b* and 3*b'* are formed on the other major surface of element 2. The varistor further comprises two electrodes 4 and 4' covering the ends of element 2. Electrode 4 also covers the parts of electrodes 3*a* and 3*b*, electrically connecting these electrodes. Similarly, electrode 4' also covers the parts of electrodes 3*a'* and 3*b'*, electrically coupling electrodes 3*a'* and 3*b'*. Portion L of element 2, which is sandwiched by the overlapping portions of electrodes 3*a* and 3*b'* provides varistor characteristics.

Figure 1:
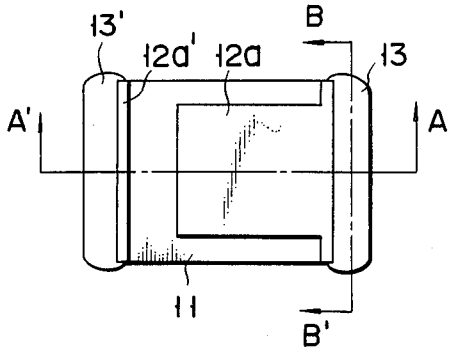
FIG. 1 PRIOR ART
FIG. 1 is a plan view of a conventional chip-type varistor.
Figure 2:
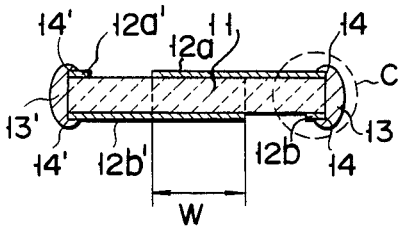
FIG. 2 PRIOR ART
FIG. 2 is a sectional view of the conventional varistor, taken along line A—A′ in FIG. 1.
Figure 3:
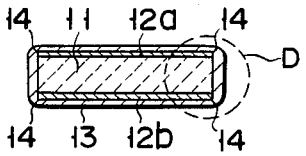
FIG. 3 PRIOR ART
FIG. 3 is a sectional view of the varistor, taken along line B—B′ in FIG. 1.
Figure 4:
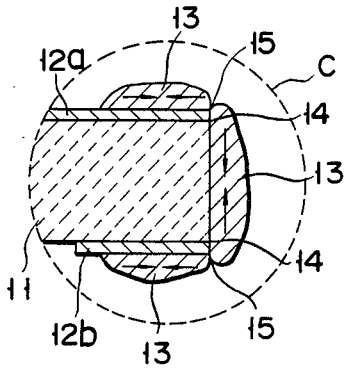
FIG. 4 PRIOR ART
FIG. 4 is an enlarged view of portion C (FIG. 2) of the varistor.
Figure 5:
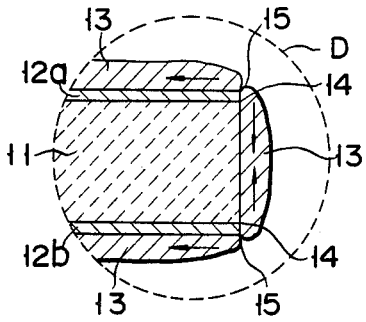
FIG. 5 PRIOR ART
FIG. 5 is an enlarged view of portion D (FIG. 3) of the varistor.
Figure 6:
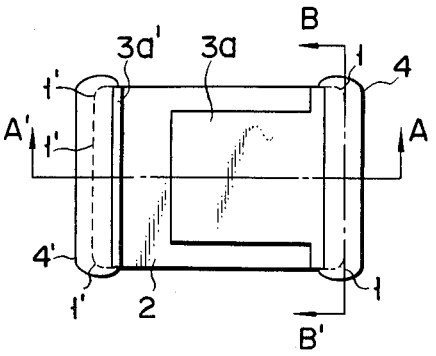
FIG. 6 is a plan view of a chip-type varistor according to the present invention.
Figure 7:
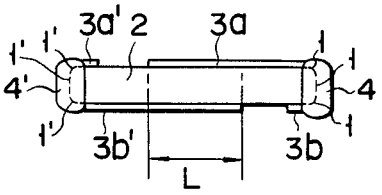
FIG. 7 is a front view of this varistor.
Figure 8:
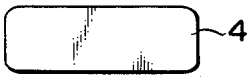
FIG. 8 is a side view of the same varistor.
Figure 9:
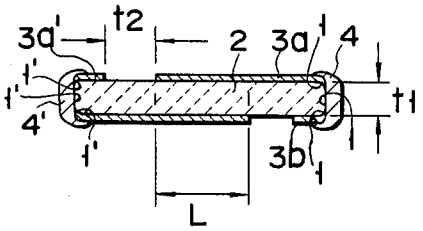
FIG. 9 is a sectional view of the varistor, taken along line A—A′ in FIG. 6.
Figure 10:
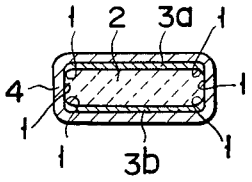
FIG. 10 is a sectional view of the varistor, taken along line B—B′ in FIG. 6.

As shown in FIGS. 6 to 10, the edges of element 2 form rounded sides and corners 1 and 1'. Electrodes 4 and 4' are formed on these edges by dipping the ends of varistor element 2 in a paste of an electrode material such as Ag or Ag-Pd alloy and then drying and baking the material attached to the ends of element 2. Those portions of electrodes 4 and 4' which are formed over the rounded sides and corner 1 and 1' are as thick as the other portions formed on the sides and major surfaces of element 2, as shown in FIGS. 9 and 10. In other words, external electrodes 4 and 4' are uniformly coated on sides and corners 1 and 1' of element 2 through a single dipping process because of the provision of rounded sides and corners 1 and 1'. Therefore, a great deal of Joule heat is not generated in those portions of either external electrode, which are formed over sides and corners 1 and 1', to melt away these portions. Also, the uniformly coated electrode 4 or 4' do not develop cracks since stress on electrodes 4 and 4' can be uniformly dispersed when the coating is dried and baked. As a result, variations in the dimensions of the varistors are eliminated, facilitating reliable mounting of the varistors on a printed circuit board.

Figure 11:
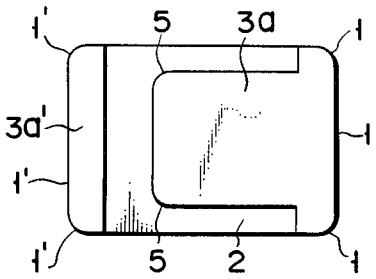
FIGS. 11 to 14 are plan views of four other chip-type varistor according to the invention, not provided with electrode 4 or 4'.
Figure 12:
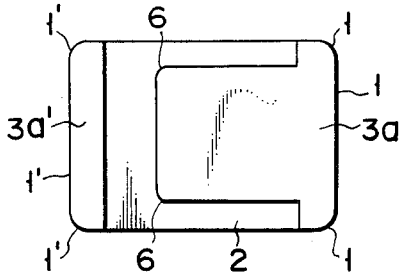
Figure 13:
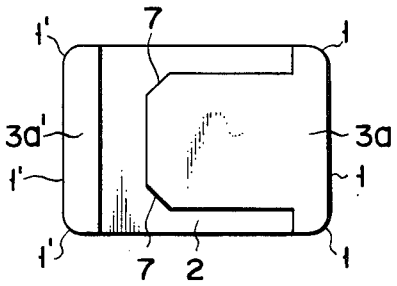
Figure 14:
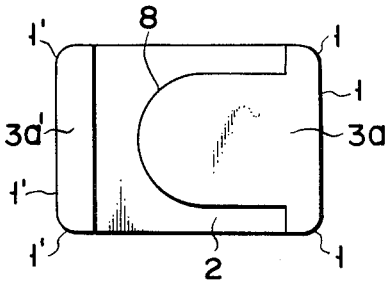

In the above embodiment, varistor electrodes 3*a* and 3*b* have right-angled corners. Electrodes 3*a* and 3*b* can be replaced by the electrode shown in FIG. 11 which has rounded corners 5, the electrode shown in FIG. 12 which has parabolic corners 6, the electrode shown in FIG. 13 whose right-angled corners have been cut off, or the electrode shown in FIG. 14 which has an arcuate end. Note that the same numerals are used in FIGS. 11 to 14, designating the same components as in the embodiment shown in FIGS. 6 to 10, and a detailed description of these components is omitted.

Referring to FIG. 9, thickness t1 of element 2 is less than distance t2 between electrodes 3*a* and 3*a'*. If the portion of element 2, between electrodes 3*a* and 3*a'* is highly resistant, however, t1 can be greater than t2. Also in this case, portion L of element 2, which is sandwiched by the overlapping portions of electrodes 3*a* and 3*b'*, provides varistor characteristics.

The characteristics of the chip-type varistor embodying the present invention (shown in FIGS. 6–10), and those of the conventional chip-type varistor (shown in FIGS. 1–5) were tested in applying a surge current of a standard waveform ($8\times20$ μsec.), and the lifetime of the respective varistors were determined. Surge test was applied to 30 pieces of zinc oxide-based varistor of the type shown in FIGS. 1–5, and also to 30 pieces of zinc oxide-based varistor of the type shown in FIGS. 6–10. The conventional varistors were damaged at 500 to 1,000 A, whereas the varistor of the invention were damaged until at 2,000 to 4,000 A. As the results demonstrate, the lifetime of the varistor of the present invention can be significantly improved due to the capacity of the varistor to withstand surge currents.

The present invention can be applied to varistors other than zinc oxide-based ones. When it is applied to varistor elements made of strontium titanate-based, iron oxide-based, barium titanate-based, and silicon carbide-based varistors, it can achieve the same advantages as when applied to zinc oxide-based varistors.

In the embodiments shown in FIGS. 6 to 10 and in FIGS. 11 to 14, the rounded sides and corners of the varistor elements were formed during the pressing of ceramic powder mixture. Instead, they can be formed after the sintering, by barell-grinding platelike varistor elements.

Furthermore, though the varistor elements of the above embodiments have no outer coating, the outer surfaces of a chip-type varistor and the surfaces of its electrodes can be coated with an insulating material (e.g., glass) if necessary.

What is claimed is:

1. A chip-type varistor comprising:

a platelike varistor element made of a sintered body having rounded sides and corners;

a pair of platelike electrodes of a first polarity and different lengths formed on two major surfaces of said varistor element and electrically insulated from each other;

a pair of platelike electrodes of a second polarity and different lengths formed on two major surfaces of said varistor element and electrically insulated from each other, one of said electrodes of the second polarity partially overlapping one of the electrodes of the first polarity;

a first external electrode formed on one of the two ends of said varistor element and connecting the electrodes of the first polarity; and a second external electrode formed on the other end of said varistor element and connecting the electrodes of the second polarity, wherein that portion of said varistor element which is sandwiched by the overlapping portions of the electrode of the first polarity and the electrode of the second polarity provides varistor characteristics.

2. A varistor according to claim 1, wherein said two overlapping electrodes extend from the ends of said varistor elements and each having a rounded end.

3. A varistor according to claim 1, wherein said two overlapping electrodes extend from the ends of said varistor elements and each having a parabolically curved end.

4. A varistor according to claim 1, wherein said two overlapping electrodes extend from the ends of said varistor elements and each having an end with two diagonal corners.

5. A varistor according to claim 1, wherein said two overlapping electrodes extend from the ends of said varistor elements and each having an arcuate end.

6. A varistor according to claim 1, wherein said varistor element is made of a composition selected from the group consisting of zinc oxide-based, strontium titanate-based, iron oxide-based, barium titanate-based, and silicon carbide-based composition.

7. A chip-type varistor comprising:

a platelike varistor element made of a sintered body having rounded sides and corners;

a pair of platelike electrodes of a first polarity and different lengths formed on two major surfaces of said varistor element and electrically insulated from each other;

a pair of platelike electrodes of a second polarity and different lengths formed on two major surfaces of said varistor element and electrically insulated from each other, one of said electrodes of said second polarity partially overlapping one of the electrodes of the first polarity;

a first external electrode formed on one of the two ends of said varistor element and connecting the electrodes of the first polarity;

a second external electrode formed on the other end of said varistor element and connecting the electrodes of the second polarity; and an outer coating formed on the surfaces of said varistor element and on the surfaces of said electrodes, wherein that portion of said varistor element which is sandwiched by the overlapping portions of the electrode of the first polarity and electrode of the second polarity provides varistor characteristics.

* * * * *